US005940101A

United States Patent [19]

Mutoh

[11] Patent Number: 5,940,101

[45] Date of Patent: Aug. 17, 1999

[54] METHOD AND APPARATUS FOR DETERMINING OPTIMUM INK DROP FORMATION-FREQUENCY IN AN INK JET PRINTER

[75] Inventor: Masayuki Mutoh, Machida, Japan

[73] Assignee: Silver Seiko, Ltd., Tokyo, Japan

[21] Appl. No.: 08/676,445

[22] Filed: Jul. 8, 1996

[51] Int. Cl.[6] ..... B41J 2/12

[52] U.S. Cl. ..... 347/78

[58] Field of Search ..... 347/78, 80, 81, 347/75, 76

[56] References Cited

U.S. PATENT DOCUMENTS 5,583,552 12/1996 Mutoh ..... 347/80

FOREIGN PATENT DOCUMENTS 4144753 5/1992 Japan .
4-220350 8/1992 Japan ..... B41J 2/06
4220350 8/1992 Japan .
2 277 394 10/1994 United Kingdom ..... 347/80

OTHER PUBLICATIONS

Nilsson, Johan "Applications of Micro Drops" Dept. of Electrical Engineering, Lunds University, Lund, Sweden (ISSN 0346–6221), Jun. 1993, pp. 90–101.

*Primary Examiner*—N. Le
*Assistant Examiner*—Thien Tran
*Attorney, Agent, or Firm*—Wallace G. Walter

[57] ABSTRACT

The optimum excitation frequency for forming successive ink drops in an ink jet printer is determined by forming a sequence of ink drops at a plurality of different drop-formation frequencies and phases thereof and integrating a detected current representative of the value of the charge on the ink drops as a function of time for each the plural frequencies and phases thereof to create a corresponding plurality of waveforms. The frequency of the optimum waveform, which minimizes the undesired formation of satellite ink drops and undesired drop dispersion, is then selected for use during the next print mode. The optimum waveform is characterized by a single maxima and minima separated in phase by a value no greater than a predetermined maximum value.

19 Claims, 8 Drawing Sheets

METHOD AND APPARATUS FOR DETERMINING OPTIMUM INK DROP FORMATION-FREQUENCY IN AN INK JET PRINTER

BACKGROUND OF THE INVENTION

1. Field of the Invention

An optimum excitation frequency, which optimizes production of satellite ink drops (very small ink drops compared to the main ink drops) and stability of the ink disintegration phase, is automatically determined and relates also to an optimum excitation frequency setting method for the continuous jet type ink jet recording apparatus.

2. Description of the Related Art

Various Ink jet recording apparatus of the continuous jet type are conventionally known and practically used. An exemplary one of such conventional continuous jet type ink jet recording apparatus is disclosed, for example, in Japanese Patent Laid-Open Application No. Heisei 4-220350 and shown in FIG. 10. As presented in FIG. 10 the continuous jet type ink jet recording apparatus shown includes, as principal components thereof, a nozzle 1 having a circular orifice of a very small diameter, an ink electrode 2 for holding the potential of ink in the nozzle 1 at the ground level, an oscillator 3 in the form of a piezoelectric oscillator mounted on the nozzle 1, a control electrode 4 having a circular opening or a slit-like opening coaxial with the nozzle 1 and connected to receive a charge controlling signal to control charging of a jet of ink in accordance with image data, a grounding electrode 5 disposed in the rear (rightwardly in FIG. 10) of the control electrode 4 and grounded itself, a knife edge 6 mounted on the grounding electrode 5, a deflection power supply E1, a deflection electrode 7 connected to the deflection power supply E1 for cooperating with the grounding electrode 5 to produce therebetween an intense electric field perpendicular to an ink jet flying axis to deflect a charged ink drop to the grounding electrode 5 side, a reference oscillator CG for generating a reference clock signal CLK of an oscillation frequency instructed from a microprocessor unit (hereinafter referred to simply as MPU) not shown, a frequency divider FD for dividing the frequency of the reference clock signal CLK by N (positive integer) to produce an excitation signal PCLK, a delayed pulse generator DG for delaying the excitation signal PCLK to produce excitation signals PCLK of phases $\theta_0$, $\theta_1$, $\theta_2$, . . . , $\theta_{N-1}$ delayed to N (positive integer) stages in response to the reference clock signal CLK, a multiplexer MP for selecting one of the excitation signals PCLK of the thus delayed phases $\theta_0$, $\theta_1$, $\theta_2$, . . . , $\theta_{N-1}$, an oscillation element driver VD for driving the oscillator 3 with the excitation signal PCLK of the phase $\theta$ selected by the multiplexer MP, a pulse width modulator PM for converting image data into a pulse width signal corresponding to a density gradation, a synchronizing circuit SC for synchronizing a rising or falling edge of the output of the pulse width modulator PM with a rising or falling edge of the excitation signal PCLK from the frequency divider FD, and a high voltage switch HVS for voltage amplifying and applying the output of the synchronizing circuit SC as a charge controlling signal to the control electrode 4. It is to be noted that reference character DR denotes a rotary drum around which a recording medium is wrapped.

In the conventional continuous jet type ink jet recording apparatus of the construction described above, the MPU variably sets the oscillation frequency of the reference clock signal CLK of the reference oscillator CG to variably set the excitation frequency of the excitation signal PCLK. The picture quality of a result of recording depends upon the ink disintegration characteristic of the nozzle 1, and the ink disintegration characteristic varies depending upon the excitation frequency of the excitation signal PCLK. Consequently, in the conventional continuous jet type ink jet recording apparatus, test images are printed successively varying the excitation frequency of the excitation signal PCLK and are checked for the picture quality by visual inspection, and an optimum excitation frequency is manually set from the outside (by means of an operation panel or the like) based on the visual check.

The conventional continuous jet type ink jet recording apparatus described above has two problems in terms of a manner of disintegration of an ink jet into ink drops from an ink column.

The first problem relates to a satellite drop which is produced between principal drops by the non-linearity of the surface deformation of an ink column. Three different modes are possible in regard to production of a satellite drop including a mode wherein a satellite drop produced is integrated with a succeeding principal drop, another mode wherein a satellite drop produced is integrated with a preceding principal drop, and a further mode wherein a satellite drop is not integrated until it comes to a recording surface. In continuous jet type ink jet recording apparatus, a still further mode wherein no satellite drop is produced is desirable. However, even if a satellite drop is produced, if it is integrated rapidly in the control electrode 4, it does not matter especially. However, when the integration occurs so late that a satellite drop is integrated in the rear of an exit of the control electrode 4 or no integration of a satellite drop occurs until it comes to a recording surface, the charged satellite drop (whose specific charge is usually higher than that of a charged principal drop) is influenced much by a deflection electric field and is deflected precedently to a charged principal drop. As a result, an electrostatic repulsive force from the satellite drop acts in a perpendicular direction to the ink jet flying axis upon the charged principal drop to obstruct correct deflection of the charged principal drop. Further, if the charged satellite drop is deflected out of a correct trajectory and integrated with a non-charged principal drop to be recorded, the noncharged principal drop is deflected a little. Any of the events described above deteriorates the picture quality very much. This problem will be hereinafter referred to as satellite drop problem.

The second problem is that the disintegration phase in (timing at) which an ink column is disintegrated into an ink drop is different among individual ink drops and is not stabilized with respect to the phase of the excitation signal PCLK. This small dispersion in disintegration phase at a disintegration point is amplified by an influence of the resistance of the air during flying of the ink drop and appears as a large fluctuation in position in the proximity or rearwardly of the knife edge 6. Further, the phase of the charge controlling signal during printing is kept fixed with reference to the phase of the excitation signal PCLK. If the disintegration phase varies in this condition, then not only the charging phase cannot be kept optimally, but also the measurement of the optimum charging phase suffers from an error. Such jet is defined as fuzzy jet. A fuzzy jet gives rise to, similarly to the satellite drop problem described above, significant reduction in picture quality because of production of an intermediate charged ink drop due to a fluctuation of the position of an ink drop in the ink jet axial direction and a fluctuation of the charging phase. This problem is defined as fuzzy jet problem.

Empirically, the two problems described above depend much upon the excitation frequency of the excitation signal PCLK. In particular, it is considered that the two problems depend upon the frequency characteristic of a mechanical oscillation system by which oscillations of the oscillator 3 mounted on the nozzle 1 are transmitted to the disintegration point of an ink jet.

In order to solve the problems described above, in a conventional continuous jet type ink jet recording apparatus, test images are printed successively varying the excitation frequency of the excitation signal PCLK and are checked by visual inspection to select an optimum excitation frequency, and the actual excitation frequency is manually set to the optimum excitation frequency. Therefore, the conventional continuous jet type ink jet recording apparatus is disadvantageous in that it is cumbersome that test images must be printed actually, that a criterion is very indefinite since it depends upon subjective visual observation of images, that setting of an excitation frequency which has been determined to be optimum is cumbersome because it is performed manually, and so forth.

SUMMARY OF THE INVENTION

It is an object of the present invention to provide a continuous jet type ink jet recording apparatus and an optimum excitation frequency setting method wherein an optimum excitation frequency against the satellite drop problem and the fuzzy jet problem is determined and an actual excitation frequency is automatically set to the optimum excitation frequency.

It is another object of the present invention to provide a continuous jet type ink jet recording apparatus including a plurality of nozzles to allow printing in color wherein an optimum excitation frequency is determined and an actual excitation frequency is automatically set to the optimum excitation frequency.

In order to attain the objects described above. according to an aspect of the present invention, there is provided a continuous jet type ink jet recording apparatus, comprising jet formation means for discharging pressurized ink as a continuous jet from a nozzle and successively disintegrating the continuous jet into ink drops of a uniform size in synchronism with excitation of an oscillator mounted on the nozzle. charging means for selectively charging the ink drops, deflection means for applying a deflection electric field perpendicular to a flying axis of the jet to an ink drop charged by the charging means to deflect the ink drop in a direction perpendicular to the jet flying axis, separation means for intercepting a charged ink drop deflected by the deflection means and allowing a straightforwardly advancing non-charged ink drop to pass thereby, variable frequency oscillation means for outputting an excitation signal for exciting the oscillator, switch means for switching the deflection electric field by the deflection means on and off, probe pulse generation means for generating a probe pulse signal in synchronism with the excitation signal outputted from the variable frequency oscillation means in a condition wherein the deflection electric field is controlled to an off state by the switch means, phase shifting means for shifting a phase of one of the excitation signal and the probe pulse signal with respect to a phase of the other, a conductive drop catcher for catching a charged ink drop charged by the probe pulse signal generated by the probe pulse generation means and having passed by the separation means, current detection means for detecting charge of charged ink drops caught by the conductive drop catcher as an electric current value, analog to digital conversion means for converting the electric current value detected by the current detection means into digital data, and optimum excitation frequency determination means for delivering an instruction to the variable frequency oscillation means to successively change an excitation frequency of the excitation signal to M stages, M being a positive integer, delivering another instruction to the phase shifting means to successively shift the phase of one of the excitation signal and the probe pulse signal with respect to the phase of the other by $2\pi/N$ with the excitation frequency at each of the stages, N being a positive integer, re-arranging the digital data obtained by the analog to digital conversion means in the order of the phases at each stage and storing the thus re-arranged data as jet current waveform data, extracting, based on the M sets of jet current waveform data thus stored, characteristics of the jet current waveforms at the individual stages to determine an optimum excitation frequency and delivering a further instruction to the variable frequency oscillation means to output an excitation signal of the optimum excitation frequency.

In the continuous jet type ink jet recording apparatus, the switch means switches the deflection electric field by the deflection means off, and the probe pulse generation means generates a probe pulse signal in synchronism with an excitation signal outputted from the variable frequency oscillation means in a condition wherein the deflection electric field is controlled to an off state by the switch means. Then, the phase shifting means shifts a phase of one of the excitation signal and the probe pulse signal with respect to a phase of the other, and the conductive drop catcher catches a charged ink drop charged by the probe pulse signal generated by the probe pulse generation means and having passed by the separation means. The current detection means detects charge of the charged ink drops caught by the conductive drop catcher as an electric current value, and the analog to digital conversion means converts the electric current value detected by the current detection means into digital data. Then, the optimum excitation frequency determination means delivers an instruction to the variable frequency oscillation means to successively change an excitation frequency of the excitation signal to M (positive integer) stages, delivers another instruction to the phase shifting means to successively shift the phase of one of the excitation signal and the probe pulse signal with respect to the phase of the other by $2\pi N$. (N is a positive integer) with the excitation frequency at each of the stages, re-arranges the digital data obtained by the analog to digital conversion means in the order of the phases at each stage and stores the thus re-arranged data as jet current waveform data, extracts, based on the M sets of jet current waveform data thus stored, characteristics of the jet current waveforms at the individual stages to determine an optimum excitation frequency and delivers a further instruction to the variable frequency oscillation means to output an excitation signal of the optimum excitation frequency.

Consequently, with the continuous jet type ink jet recording apparatus, the following advantages can be anticipated. In particular, the cumbersome operation of actually printing a test image can be eliminated. Further, since the criterion for the optimum excitation frequency is based on the detection value of the jet current, very accurate discrimination can be achieved. Furthermore, since determination of an optimum excitation frequency and setting of an actual excitation frequency to the optimum excitation frequency are automated, very simple and high speed operation can be achieved.

According to another aspect of the present invention, there is provided a continuous jet type ink jet recording apparatus, comprising n jet formation means each for discharging pressurized ink as a continuous jet from a nozzle and successively disintegrating the continuous jet into ink drops of a uniform size in synchronism with excitation of an oscillator mounted on the nozzle, n being an integer equal to or greater than 2, n charging means each for selectively charging the ink drops, deflection means for applying a deflection electric field perpendicular to flying axes of the jets to each ink drop charged by the charging means to deflect the ink drop in a direction perpendicular to the jet flying axis, separation means for intercepting a charged ink drop deflected by the deflection means and allowing a straightforwardly advancing non-charged ink drop to pass thereby, variable frequency oscillation means for outputting an excitation signal for commonly exciting the n oscillators, switch means for switching the deflection electric field by the deflection means on and off, probe pulse generation means for generating a probe pulse signal in synchronism with the excitation signal outputted from the variable frequency oscillation means in a condition wherein the deflection electric field is controlled to an off state by the switch means, n phase shifting means each for shifting a phase of one of the corresponding excitation signal and the probe pulse signal with respect to a phase of the other, a conductive drop catcher for catching a charged ink drop charged by the probe pulse signal generated by the probe pulse generation means and having passed by the separation means, current detection means for detecting charge of charged ink drops caught by the conductive drop catcher as an electric current value, analog to digital conversion means for converting the electric current value detected by the current detection means into digital data, and optimum excitation frequency determination means for delivering, successively for each of the n net formation means, an instruction to the variable frequency oscillation means to successively change an excitation frequency of the excitation signal to M stages, M being a positive integer, and then another instruction to the corresponding phase shifting means to successively shift the phase of one of the excitation signal and the probe pulse signal with respect to the phase of the other by $2\pi/N$ with the excitation frequency at each of the stages, N being a positive integer, re-arranging the digital data obtained in regard to each of the jet formation means by the analog to digital conversion means in the order of the phases at each stage and storing the thus re-arranged data as jet current waveform data, extracting, based on the nxM sets of jet current waveform data thus stored, characteristics of the jet current waveforms to determine an optimum excitation frequency and delivering a further instruction to the variable frequency oscillation means to output an excitation signal of the optimum excitation frequency.

In the continuous jet type ink jet recording apparatus, the switch means switches the deflection electric field by the deflection means off, and the probe pulse generation means generates a probe pulse signal in synchronism with an excitation signal outputted from the variable frequency oscillation means in a condition wherein the deflection electric field is controlled to an off state by the switch means. Each of the n phase shifting means shifts a phase of one of the corresponding excitation signal and the probe pulse signal with respect to a phase of the other, and the conductive drop catcher catches a charged ink drop charged by the probe pulse signal generated by the probe pulse generation means and having passed by the separation means. The current detection means detects the charge of the charged ink drops caught by the conductive drop catcher as an electric current value, and the analog to digital conversion means converts the electric current value detected by the current detection means into digital data. Then, the optimum excitation frequency determination means delivers, successively for each of the n net formation means, an instruction to the variable frequency oscillation means to successively change an excitation frequency of the excitation signal to M (positive integer) stages and then another instruction to the corresponding phase shifting means to successively shift the phase of one of the excitation signal and the probe pulse signal with respect to the phase of the other by $2\pi/N$ (N is a positive integer) with the excitation frequency at each of the stages, re-arranges the digital data obtained in regard to each of the jet formation means by the analog to digital conversion means in the order of the phases at each stage and stores the thus re-arranged data as jet current waveform data. Further, the optimum excitation frequency determination means extracts, based on the nxM sets of jet current waveform data thus stored, characteristics of the jet current waveforms to determine an optimum excitation frequency and delivers a further instruction to the variable frequency oscillation means to output an excitation signal of the optimum excitation frequency.

Consequently, also the continuous jet type ink jet recording apparatus is advantageous in that the cumbersome operation of actually printing a test image can be eliminated, that, since the criterion for the optimum excitation frequency is based on the detection value of the jet current, very accurate discrimination can be achieved, and that, since determination of an optimum excitation frequency and setting of an actual excitation frequency to the optimum excitation frequency are automated, very simple and high speed operation can be achieved.

According to a further aspect of the present invention, there is provided a continuous jet type ink jet recording apparatus, comprising n jet formation means each for discharging pressurized ink as a continuous jet from a nozzle and successively disintegrating the continuous jet into ink drops of a uniform size in synchronism with excitation of an oscillator mounted on the nozzle, n being an integer equal to or greater than 2, n charging means each for selectively charging the ink drops, deflection means for applying a deflection electric field perpendicular to flying axes of the jets to each ink drop charged by the charging means to deflect the ink drop in a direction perpendicular to the jet flying axis, separation means for intercepting a charged ink drop deflected by the deflection means and allowing a straightforwardly advancing non-charged ink drop to pass thereby, variable frequency oscillation means for outputting an excitation signal for commonly exciting the n oscillators, switch means for switching the deflection electric field by the deflection means on and off, probe pulse generation means for generating a probe pulse signal in synchronism with the excitation signal outputted from the variable frequency oscillation means in a condition wherein the deflection electric field is controlled to an off state by the switch means, n phase shifting means each for shifting a phase of one of the corresponding excitation signal and the probe pulse signal with respect to a phase of the other, n conductive drop catchers each for catching a charged ink drop charged by the probe pulse signal generated by the probe pulse generation means and having passed by the separation means, n current detection means each for detecting the charge of the charged ink drops caught by the corresponding conductive drop catcher as an electric current value, n analog to digital conversion means for converting the electric current values detected by the n current detection means into digital data, and optimum excitation frequency determination means for delivering, simultaneously for the n net formation means, an instruction to the variable frequency oscillation means to successively change an excitation frequency of the excitation signal to M stages, M being a positive integer, and then another instruction to each of the n phase shifting means to successively shift the phase of one of the excitation signal and the probe pulse signal with respect to the phase of the other by $2\pi/N$ with the excitation frequency at each of the stages, N being a positive integer, re-arranging the digital data obtained in regard to each of the jet formation means by the analog to digital conversion means in the order of the phases at each stage and storing the thus re-arranged data as jet current waveform data, extracting, based on the nxM sets of jet current waveform data thus stored, characteristics of the jet current waveforms to determine an optimum excitation frequency and delivering a further instruction to the variable frequency oscillation means to output an excitation signal of the optimum excitation frequency.

In the continuous jet type ink jet recording apparatus, the switch means switches the deflection electric field by the deflection means off, and the probe pulse generation means generates a probe pulse signal in synchronism with an excitation signal outputted from the variable frequency oscillation means in a condition wherein the deflection electric field is controlled to an off state by the switch means. Each of the n phase shifting means shifts a phase of one of the corresponding excitation signal and the probe pulse signal with respect to a phase of the other, and each of the n conductive drop catchers catches a charged ink drop charged by the probe pulse signal generated by the probe pulse generation means and having passed by the separation means. Each of the n current detection means detects the charge of charged ink the drops caught by the corresponding conductive drop catcher as an electric current value, and the n analog to digital conversion means convert the electric current values detected by the n current detection means into digital data. Then, the optimum excitation frequency determination means delivers, simultaneously for the n net formation means, an instruction to the variable frequency oscillation means to successively change an excitation frequency of the excitation signal to M (positive integer) stages and then another instruction to each of the n phase shifting means to successively shift the phase of one of the excitation signal and the probe pulse signal with respect to the phase of the other by $2\pi/N$ (N is a positive integer) with the excitation frequency at each of the stages, re-arranges the digital data obtained in regard to each of the jet formation means by the analog to digital conversion means in the order of the phases at each stage and stores the thus re-arranged data as jet current waveform data. Further, the optimum excitation frequency determination means extracts, based on the nxM sets of jet current waveform data thus stored, characteristics of the jet current waveforms to determine an optimum excitation frequency and delivers a further instruction to the variable frequency oscillation means to output an excitation signal of the optimum excitation frequency.

Consequently, also the continuous jet type ink jet recording apparatus is advantageous in that the cumbersome operation of actually printing a test image can be eliminated, that, since the criterion for the optimum excitation frequency is based on the detection value of the jet current, very accurate discrimination can be achieved, and that, since determination of an optimum excitation frequency and setting of an actual excitation frequency to the optimum excitation frequency are automated, very simple and high speed operation can be achieved.

According to a still further aspect of the present invention, there is provided an optimum excitation frequency setting method, comprising the steps of discharging pressurized ink as a continuous jet from a nozzle and successively disintegrating the continuous jet into ink drops of a uniform size in synchronism with excitation of an oscillator mounted on the nozzle, generating a probe pulse signal in synchronism with an excitation signal for the oscillator, charging an ink drop with the probe pulse signal thus generated, detecting charge of thus charged ink drops as an electric current value, converting the thus detected electric current value into digital data, and successively changing an excitation frequency of the excitation signal to M stages, M being a positive integer, successively shifting the phase of one of the excitation signal and the probe pulse signal with respect to the phase of the other by $2\pi/N$ with the excitation frequency at each of the stages, N being a positive integer, re-arranging the digital data obtained by the analog to digital conversion in the order of the phases at each stage and storing the thus re-arranged data as jet current waveform data, extracting, based on the M sets of jet current waveform data thus stored, characteristics of the jet current waveforms at the individual stages to determine an optimum excitation frequency, and outputting an excitation signal of the optimum excitation frequency.

The optimum excitation frequency setting method is advantageous in that, since the criterion for the optimum excitation frequency is based on the detection value of the jet current, very accurate discrimination can be achieved.

According to a yet further aspect of the present invention, there is provided an optimum excitation frequency setting method, comprising the steps of discharging pressurized ink as a continuous jet from each of n nozzles an d successively disintegrating the continuous jet into ink drops of a uniform size in synchronism with excitation of an oscillator mounted on each of the nozzles, n being an integer equal to or greater than 2, generating a probe pulse signal in synchronism with an excitation signal for the oscillator, charging an ink drop with the probe pulse signal thus generated, detecting the charge of thus charged ink drops as an electric current value, converting the thus detected electric current value into digital data, and successively changing, successively for each of the n nozzles, an excitation frequency of the excitation signal to M stages, M being a positive integer, and successively shifting the phase of one of the excitation signal and the probe pulse signal with respect to the phase of the other by $2\pi/N$ with the excitation frequency at each of the stages, N being a positive integer, rearranging the digital data obtained in regard to each of the n nozzles by the analog to digital conversion in the order of the phases at each stage and storing the thus re-arranged data as jet current waveform data, extracting, based on the nxM sets of jet current waveform data thus stored, characteristics of the jet current waveforms at the individual stages to determine an optimum excitation frequency, and outputting an excitation signal of the optimum excitation frequency.

Also the optimum excitation frequency setting method is advantageous in that, since the criterion for the optimum excitation frequency is based on the detection value of the jet current, very accurate discrimination can be achieved.

According to a yet further aspect of the present invention, there is provided an optimum excitation frequency setting method, comprising the steps of discharging pressurized ink as a continuous jet from each of n nozzles and successively disintegrating the continuous jet into ink drops of a uniform size in synchronism with excitation of an oscillator mounted on each of the nozzles, n being an integer equal to or greater than 2, generating a probe pulse signal in synchronism with an excitation signal for the oscillator, charging an ink drop with the probe pulse signal thus generated, detecting the charge of thus charged ink drops as an electric current value, converting the thus detected electric current value into digital data, and successively changing, simultaneously for the n nozzles, an excitation frequency of the excitation signal to M stages, M being a positive integer, and successively shifting the phase of one of the excitation signal and the probe pulse signal with respect to the phase of the other by $2\pi/N$ with the excitation frequency at each of the stages, N being a positive integer, re-arranging the digital data obtained in regard to each of the n nozzles by the analog to digital conversion in the order of the phases at each stage and storing the thus re-arranged data as jet current waveform data, extracting, based on the nxM sets of jet current waveform data thus stored, characteristics of the jet current waveforms at the individual stages to determine an optimum excitation frequency, and outputting an excitation signal of the optimum excitation frequency.

Also the optimum excitation frequency setting method is advantageous in that, since the criterion for the optimum excitation frequency is based on the detection value of the jet current, very accurate discrimination can be achieved.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENTS

Figure 1:
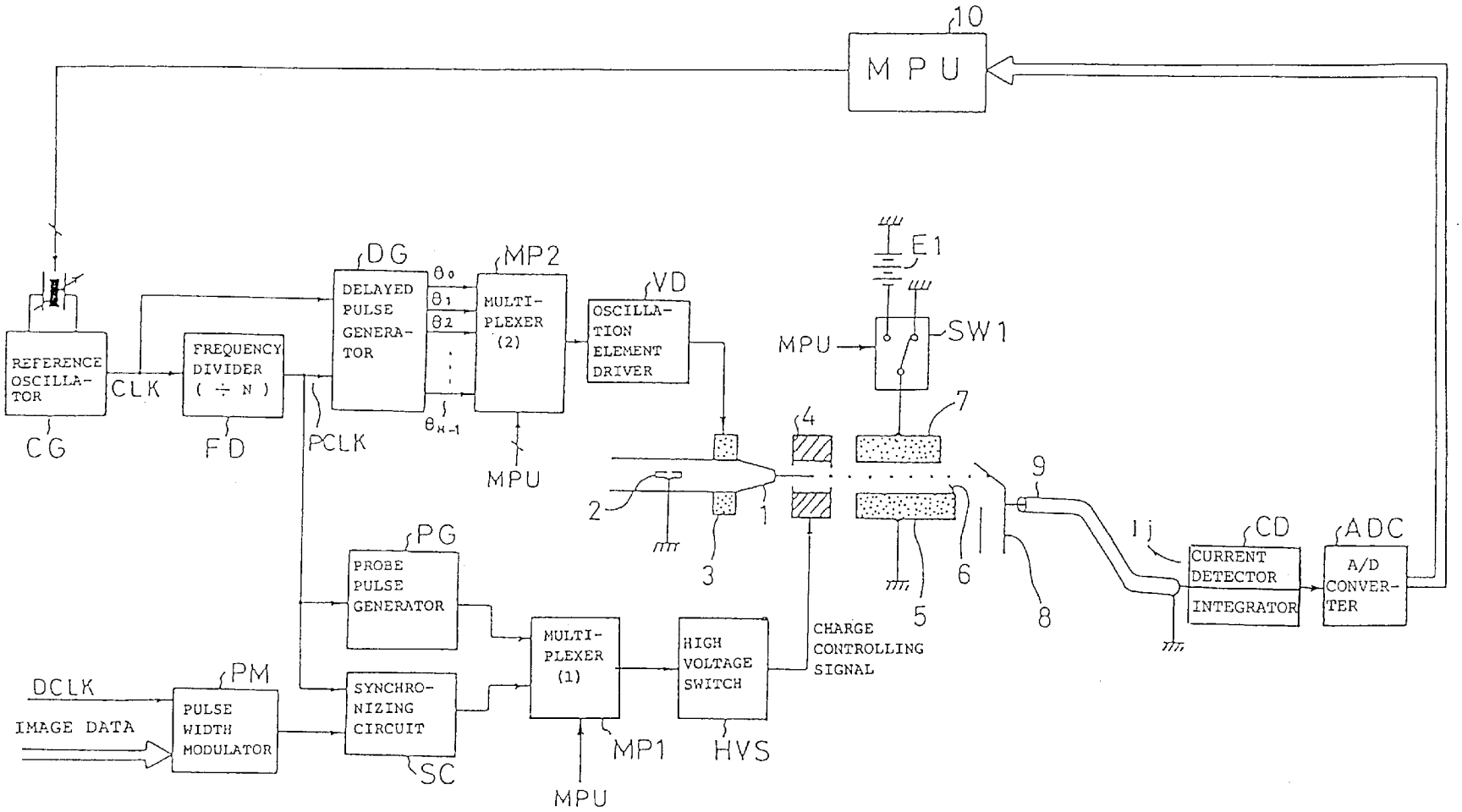
FIG. 1 is a block diagram showing a general construction of a continuous jet type ink jet recording apparatus to which the present invention is applied.

As shown in FIG. 1, there is shown a continuous jet type ink jet recording apparatus to which the present invention is applied. The continuous jet type ink jet recording apparatus shown includes, as principal components thereof, a nozzle 1 having a circular orifice of a very small diameter, an ink electrode 2 for holding the potential of ink in the nozzle 1 at the ground level, an oscillator 3 in the form of a piezoelectric oscillator mounted on the nozzle 1, a control electrode 4 having a circular opening or a slit-like opening coaxial with the nozzle 1 and connected to receive a charge controlling signal to control charging of a jet of ink in accordance with image data, a grounding electrode 5 disposed in the rear of the control electrode 4 and grounded itself, a knife edge 6 mounted on the grounding electrode 5, a deflection power supply E1, a deflection electrode 7 connected to the deflection power supply E1 for cooperating with the grounding electrode 5 to produce therebetween an intense electric field perpendicular to an ink jet flying axis to deflect a charged ink drop to the grounding electrode 5 side, a switch SW1 for switchably connecting the deflection electrode 7 to the deflection power supply E1 or the ground, a reference oscillator CG for generating a reference clock signal CLK of an oscillation frequency instructed from an MPU 10, a frequency divider FD for dividing the frequency of the reference clock signal CLK by N (positive integer) to produce an excitation signal PCLK, a delayed pulse generator DG for delaying the excitation signal PCLK to N (positive integer) stages in response to the reference clock signal CLK to produce pulse trains $\theta_0, \theta_1, \theta_2, \ldots, \theta_{N-1}$, a multiplexer (2) MP2 for selecting one of the delayed pulse trains $\theta_0, \theta_1, \theta_2, \ldots \theta_{N-1}$, an oscillation element driver VD for driving the oscillator 3 with the pulse signal selected by the multiplexer (2) MP2, a pulse width modulator PM for converting image data into a pulse width signal corresponding to a density gradation, a probe pulse generator PG for generating a probe pulse signal having a pulse width sufficiently shorter than the period of the excitation signal PCLK in synchronism with a rising or falling edge of the excitation signal PCLK, a synchronizing circuit SC for synchronizing a rising or falling edge of the output of the pulse width modulator PM with a rising or falling edge of the excitation signal PCLK from the frequency divider FD, a multiplexer (1) MP1 for selecting one of the probe pulse signal from the probe pulse generator PG and the output of the synchronizing circuit SC, a high voltage switch HVS for voltage amplifying and applying the output of the multiplexer (1) MP1 as a charge controlling signal to the control electrode 4, a conductive drop catcher 8 disposed at a position (hereinafter referred to as home position) in a region, which does not participate in recording, rearwardly of the grounding electrode 5 and the deflection electrode 7 and serving also as a detection electrode, a shield line 9 having an end connected to the conductive drop catcher 8, a current detector (current to voltage converter) CD for measuring the charge of ink drops discharged from an ink jet to the conductive drop catcher 8, an analog to digital (A/D) converter ADC for converting the output of the current detector CD from an analog signal into a digital signal, and the MPU 10 for controlling the reference oscillator CG to oscillate with an oscillation frequency of the reference clock signal CLK in response to the output of the analog to digital converter ADC. It is to be noted that the MPU 10 also controls the entire system of the continuous jet type ink jet recording apparatus of the present embodiment.

The reference oscillator CG oscillates the reference clock signal CLK in response to an instruction from the MPU 10 so that the oscillation frequency thereof is set to one of frequencies $f_0, f_1, f_2, f_3, \ldots$, fM−1 obtained by dividing a frequency band ranging within ±5% to ±10% from a center frequency equally by M (positive integer).

The delayed pulse generator DG is formed from, for example, an N-bit shift register of the serial-in parallel-out type.

The probe pulse generator PG is formed from, for example, a monostable multivibrator triggered by an edge of the excitation signal PCLK.

The current detector CD is formed from an integration circuit. The current detector CD has an integration time, for example, longer than $2\times10^4$ times the disintegration period. Consequently, the current detector CD detects accumulated charge of more than $2\times10^4$ ink drops (refer to Japanese Patent Laid-Open Application No. Heisei 4-144753).

Subsequently, operation of the continuous jet type ink jet recording apparatus of the first embodiment having the construction described above will be described. It is to be noted that this operation is executed when a carriage (not shown) on which the nozzle 1 is carried is at its home position and a process prepared in advance for automatically setting an optimum excitation frequency is started.

First, ink is pressurized by an ink pump (not shown) and introduced into the nozzle 1 through an ink tube (not shown) so that a jet of the ink is jetted from the nozzle 1. Thereafter, the ink jet is continuously jetted in a steady condition. Then, the MPU 10 switches the switch SW1 to the grounding side to ground the deflection electrode 7. Consequently, the deflection electric field between the grounding electrode 5 and the deflection electrode 7 is turned off. As a result, also a charged ink drop is thereafter allowed to pass by the knife edge 6. Further, the MPU 10 controls the multiplexer (1) MP1 to select the output of the probe pulse generator PG.

In this condition, the MPU 10 successively delivers instructions of the following operations to set an oscillation frequency of the reference clock signal CLK of the reference oscillator CG to optimize the excitation frequency of the excitation signal PCLK.

① The oscillation frequency of the reference clock signal CLK is set to $f_0$, and the jet current waveform (charging characteristic of the jet) at $f_0$ is measured by the following procedure.

The reference oscillator CG outputs the reference clock signal CLK. The reference clock signal CLK is divided by N in frequency by the frequency divider FD and inputted as the excitation signal PCLK to the delayed pulse generator DG, probe pulse generator PG and synchronizing circuit SC. In particular, the excitation frequency PCLK of the excitation signal PCLK (in the following description, a signal and its frequency may be denoted by the same reference characters) is CLK/N (for example, CLK=16 MHz, N=16, PCLK=1 MHz).

The delayed pulse generator DG receives the excitation signal PCLK and the reference clock signal CLK as input data and an input shift clock signal, respectively, and outputs N pulse trains $\theta_0, \theta_1, \theta_2, \ldots, \theta_{N-1}$ having a period of the excitation signal PCLK successively delayed by $2\pi/N$. One of the N pulse trains $\theta_0, \theta_1, \theta_2, \ldots, \theta_{N-1}$ is selected by the multiplexer (2) MP2 under the control of the MPU 10 and outputted to the oscillation element driver VD. The oscillation element driver VD excites the oscillator 3 in response to the output of the multiplexer (2) MP2. Consequently, the ink jet jetted from the nozzle 1 is disintegrated into a drop in synchronism with the excitation by the oscillator 3.

The probe pulse generator PG generates, in synchronism with a rising or falling edge (same one as that upon recording) of the excitation signal PCLK, a probe pulse signal having a pulse width sufficiently shorter than the period of the excitation signal PCLK (for example, when the period of the excitation signal PCLK is 1 μsec (oscillation by 1 MHz), the pulse width is 0.1 to 0.3 μsec).

The probe pulse signal outputted from the probe pulse generator PG is inputted via the multiplexer (1) MP1 to the high voltage switch HVS, by which it is voltage amplified and applied as a charge controlling signal to the control electrode 4. Accordingly, an ink drop disintegrated in synchronism with the excitation of the oscillator 3 is charged in response to the probe pulse signal. Now, since the polarity of the probe pulse signal is the negative, an ink drop is usually charged, but only within a time within which the probe pulse signal is applied as a controlling signal to the control electrode 4 (for example, 0.1 to 0.3 μsec), the charging voltage is controlled to an off state.

An ink drop charged by the control electrode 4 is not deflected since the deflection electric field is in an off state, and passes by the knife edge 6 and is caught by the conductive drop catcher 8 at the home position which is in an isolated condition from any other element.

Charge of charged ink drops caught by the conductive drop catcher 8 flow as jet current $I_j$ through the shield line 9 and appears as a voltage at the output of current detector CD. The voltage converted from the jet current $I_j$ is then converted into digital data by the analog to digital converter ADC and outputted to a data bus of the MPU 10.

Figure 2:
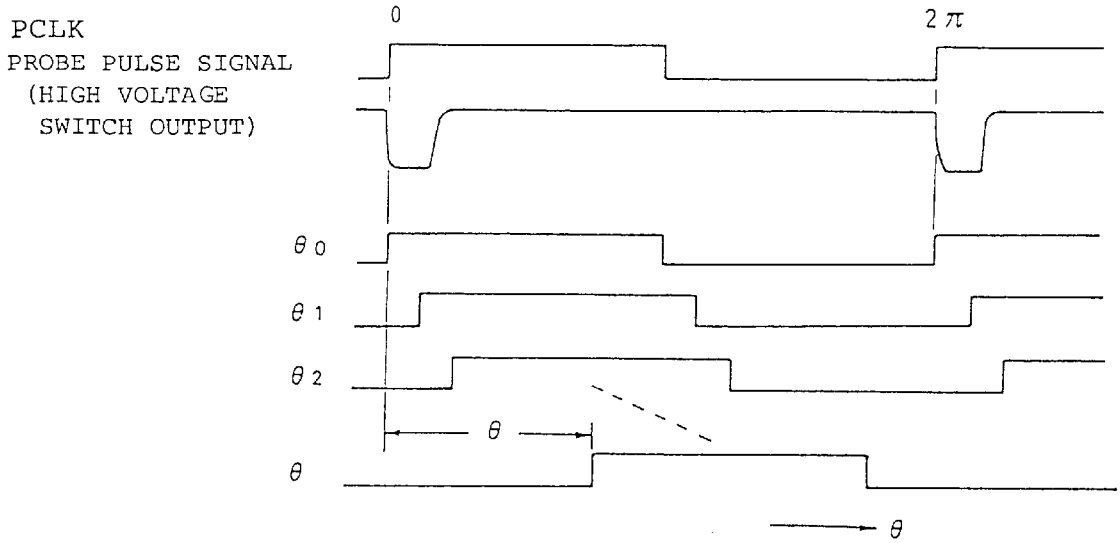
FIG. 2 is a time chart illustrating outputs of a frequency divider, a probe pulse generator and a delay pulse generator shown in FIG. 1.

Measurement of the jet current $I_j$ is performed for the individual phases in such a manner that, as seen in FIG. 2, the MPU 10 successively switches the multiplexer (2) MP2 so that the oscillator 3 is successively driven with the pulse trains $\theta_0, \theta_1, \theta_2, \ldots, \theta_{N-1}$ having phases successively delayed by $2\pi i/N$ (i=0, 1, 2, . . . , N−1) with respect to the excitation signal PCLK to excite the nozzle 1.

Values of the jet current $I_j$ measured for the individual phases are converted from analog into digital values by the analog to digital converter ADC and individually stored into the memory (not shown) of the MPU 10.

Figure 3:
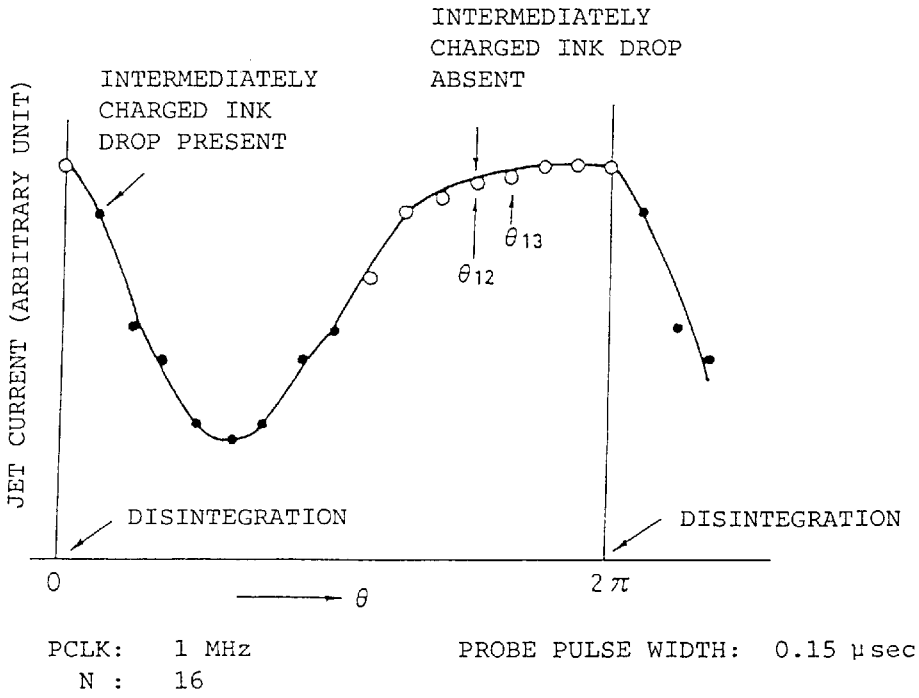
FIG. 3 is a graph showing a jet current waveform obtained by plotting values of jet current measured on the continuous jet type ink jet recording apparatus of FIG. 1.

FIG. 3 is a graph showing a jet current waveform obtained by plotting values of the jet current $I_j$ measured for each phase using a probe pulse signal. As shown in FIG. 3, whether or not an intermediately charged ink drop is present is determined by stroboscope observation using a microscope, and the mark ○ represents absence of an intermediately charged ink drop while the mark ● represents presence of an intermediately charged ink drop. That a result of the measurement exhibits such a tendency as seen in FIG. 3 is described in detail in Johan Nilsson, "Applications of Micro Drops", Dept. of Electrical Measurements, Lund Inst. of Technology, Report 6/1993, pp. 90–101. Further, a technique of measuring the jet current $I_j$ is disclosed in detail in Japanese Patent Laid-Open Application No. Heisei 4-144753 by the inventor of the present invention.

② Thereafter, the MPU 10 successively sets the oscillation frequency of the reference clock signal CLK of the reference oscillator CG to $f_1, f_2, f_3, \ldots, f_{M-1}$ and measures the jet current waveform with each of the oscillation frequencies in a similar manner as described above.

③ After the measurement of M sets of jet current waveform data with the oscillation frequencies $f_0, f_1, f_2, f_3, \ldots, f_{M-1}$ is completed, the MPU 10 extracts characteristics of the jet current waveforms based on the M sets of jet current waveform data stored in the memory, determines an optimum excitation frequency of the excitation signal PCLK, and sets the oscillation frequency of the reference clock signal CLK of the reference oscillator CG to the optimum excitation frequency. In particular, since whether or not the satellite drop problem and the fuzzy jet problem actually occur can be determined empirically from the shape of a jet current waveform, the MPU 10 extracts, from the M sets of jet current waveform data, excitation frequencies with which no satellite drop is produced or with which, even if a satellite drop is produced, it is integrated rapidly in the control electrode 4 and has no bad influence on a principal drop. Then, the MPU 10 discriminates, from among the thus extracted excitation frequencies, an excitation frequency with which the disintegration phase is most stable (most non-fuzzy), and determines the thus discriminated excitation frequency as an optimum excitation frequency.

Figure 4:
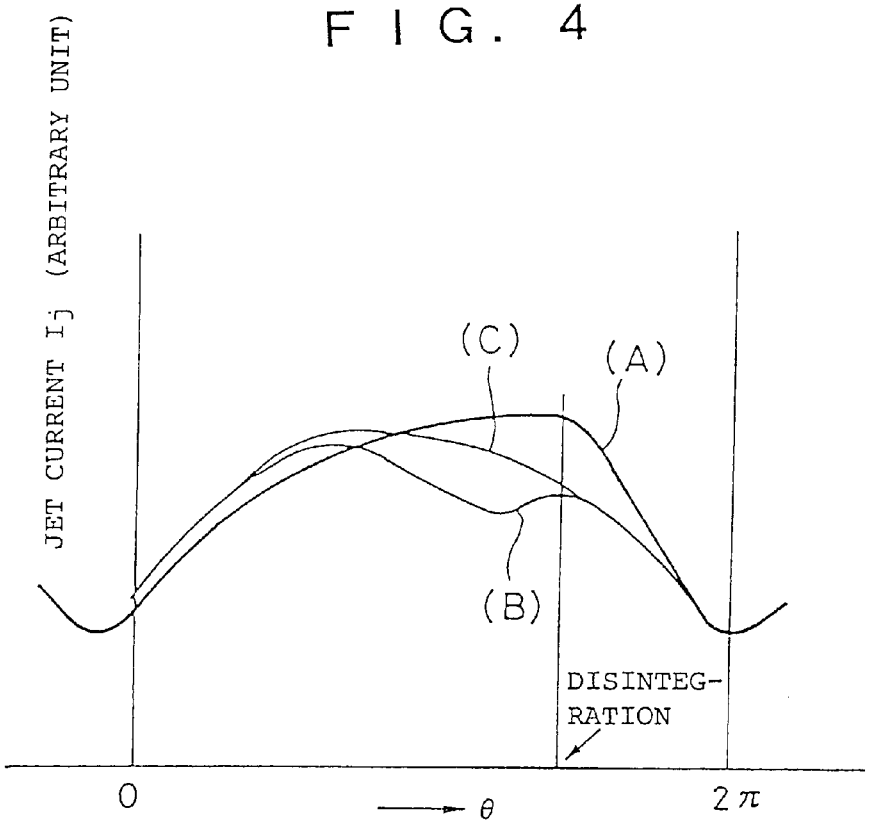
FIG. 4 is a graph illustrating a normal jet current waveform and another jet current waveform, which suffers from the satellite drop problem, measured on the continuous jet type ink jet recording apparatus of FIG. 1.

FIG. 4 is a graph which shows a normal jet current waveform (A) which does not suffer from the satellite drop problem and jet current waveforms (B) and (C) which suffer from the satellite drop problem. The normal jet current waveform (A) exhibits a simple waveform which has a single maximum point (highest point) and a single minimum point (lowest point). Further, when the phase is successively delayed like $\theta_{N-1}\rightarrow\theta_{N-2}\rightarrow\ldots\rightarrow\theta_1\rightarrow\theta_0$, the maximum point appears later than and comparatively in the proximity of (small in phase difference from) the minimum point. In the normal jet current waveform (A), the maximum point corresponds to the disintegration phase of a principal drop. On the other hand, the jet current waveform (B). which suffers from the satellite drop problem, includes two maximum points and two minimum points. When the phase is successively delayed like $\theta_{N-1}\rightarrow\theta_{N-2}\rightarrow\ldots\rightarrow\theta_1\rightarrow\theta_0$, the maximum point which appears subsequently to the lowest point is the disintegration phase point of a principal drop, and the highest point appears after the other minimum point next to the maximum point. In the meantime, the jet current waveform (C) which suffers from the satellite drop problem includes a single maximum point (highest point) and a single minimum point (lowest point), which, however, are spaced away by a very long distance from each other (large in phase difference between them). When the phase is successively delayed like $\theta_{N-1}\rightarrow\theta_{N-2}\rightarrow\ldots\rightarrow\theta_1\rightarrow\theta_0$, the maximum point appears at a position spaced rearwardly by a large distance (with a great phase difference) from the minimum point. This maximum point does not correspond to the disintegration phase of a principal drop. It is to be noted that the jet current waveform (C) which suffers from the satellite drop problem can be regarded as that of a case wherein the jet current waveform (B) which suffers from the satellite drop problem does not include the minor minimum point. In order to extract only the normal jet current waveform (A) from among the three kinds of jet current waveforms (A), (B) and (C), for example, the minimum point is found out first, and then the phase is successively delayed from the point. In this instance, it can be determined that, if the maximum point is found out successfully within a fixed range in phase from the point, then the jet current waveform is normal (normal jet current waveform (A)), but in any other case, the jet current waveform is not normal and may be the jet current waveform (B) or (C). The fixed range in phase can be determined empirically.

Figure 5:
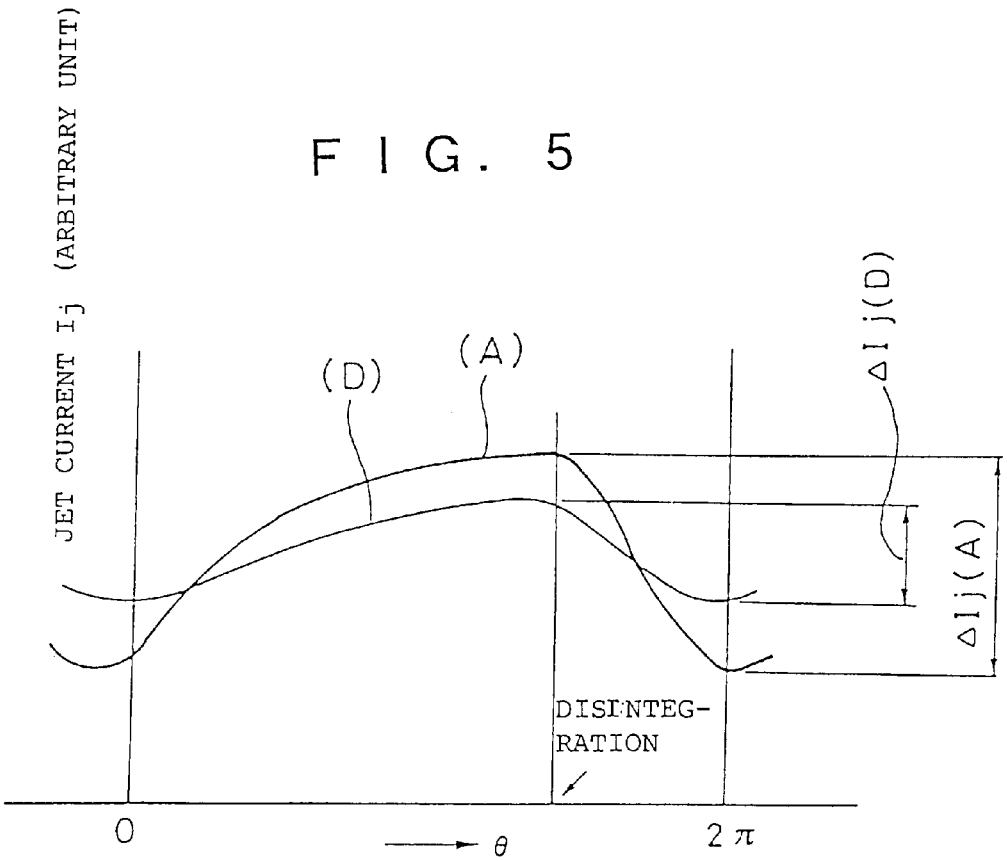
FIG. 5 is a graph illustrating a stable jet current waveform and another jet current waveform, which suffers from the fuzzy jet problem, measured with on the continuous jet type ink jet recording apparatus of FIG.

FIG. 5 is a graph showing a jet current waveform (A) which exhibits a stable disintegration phase and another jet current waveform (D) which exhibits an unstable disintegration phase (fuzzy jet). Since the current detector CD is formed from an integration circuit, comparing with the jet current waveform (A) which exhibits a stable disintegration phase, the jet current waveform (D) which exhibits an unstable disintegration phase presents a lower contrast $\Delta I_j$ which is a difference between the highest value and the lowest value of the jet current $I_j$ ($\Delta I_j(D)<\Delta I_j(A)$).

From the foregoing, those jet current waveforms which suffer from the satellite drop problem are first removed from the M sets of jet current waveforms, and then from among the remaining jet current waveforms, a jet current waveform which exhibits the highest contrast $\Delta I_j$ is determined. The excitation frequency of the thus determined jet current waveform is an optimum excitation frequency (criterion for the optimum excitation frequency).

Figure 6:
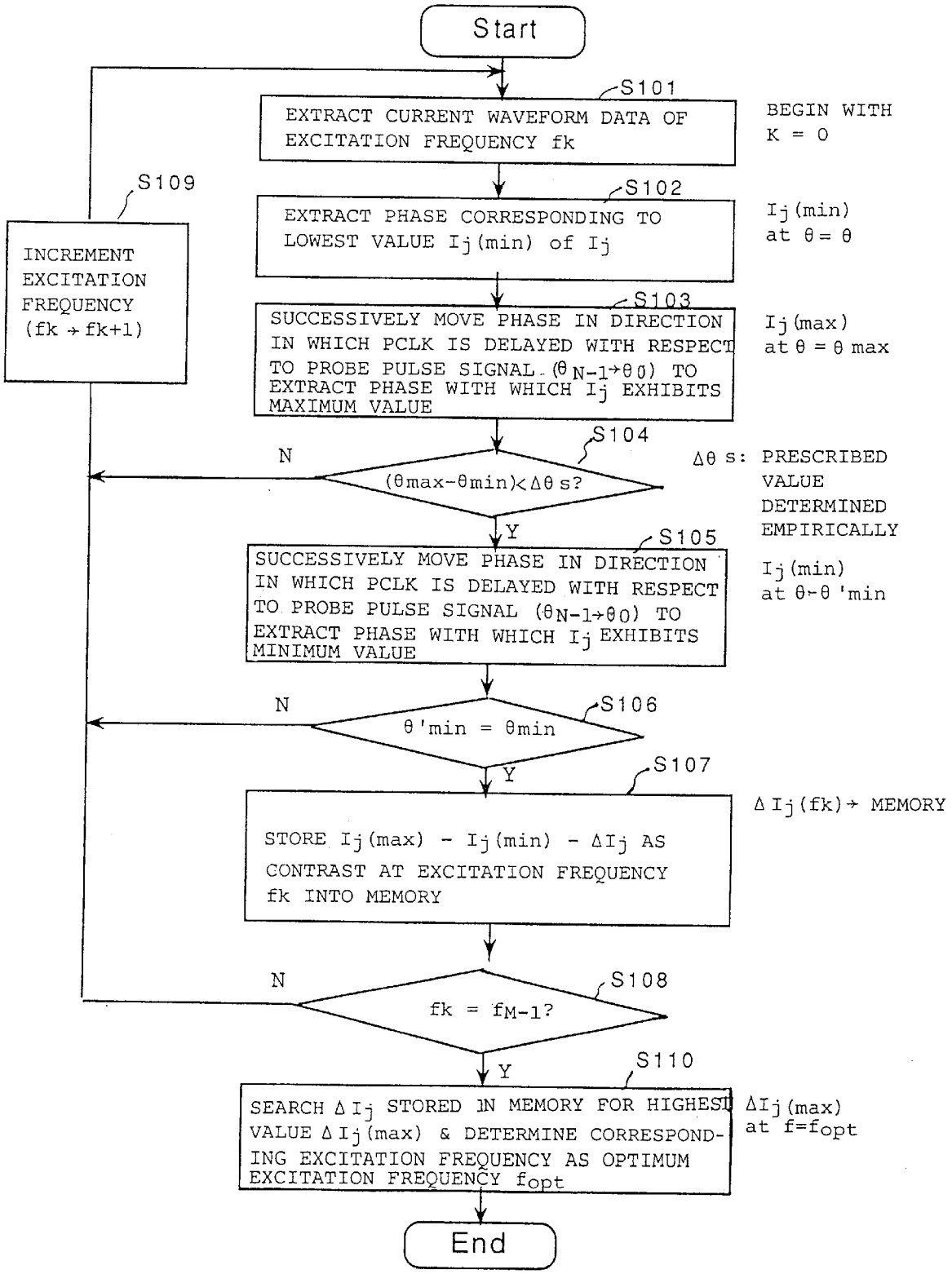
FIG. 6 is a flow chart illustrating an optimum excitation frequency determination process executed by an MPU shown in FIG. 1.

FIG. 6 is a flow chart illustrating an optimum excitation frequency determination process executed by the MPU 10 based on the criterion for the optimum excitation frequency described above. As shown in FIG. 6, the optimum excitation frequency determination process includes a current waveform data extraction step S101, a jet current lowest value corresponding phase extraction step S102, a jet current maximum value corresponding phase extraction step S103, a phase difference discrimination step S104, a jet current minimum value corresponding phase extraction step S105, a lowest value corresponding phase/minimum value corresponding phase comparison step S106. a contrast storage step S107, an excitation frequency highest discrimination step S108, an excitation frequency increment step S109, and an optimum excitation frequency determination step S110.

Operation of the MPU 10 in the optimum excitation frequency determination process will be described below with reference to FIG. 6.

First, the MPU 10 extracts current waveform data of an excitation frequency $f_K$ (beginning with K=0) (step S101), and extracts a phase $\theta_{min}$ corresponding to the lowest value $I_j$ (min) of the jet current $I_j$ (step S102).

Then, the MPU 10 successively moves the phase in a direction in which the excitation signal PCLK is delayed with respect to a probe pulse signal ($\theta_{N-1}\rightarrow\theta_0$) to extract a phase $\theta_{max}$ with which the jet current $I_j$ exhibits a maximum value (step S103).

Thereafter, the MPU 10 discriminates whether or not the difference $\theta_{max}-\theta_{min}$ is smaller than a prescribed value $\Delta\theta_s$ determined empirically (step S104). If the phase difference is not smaller, then the excitation frequency $f_K$ is incremented by one (step S109), and then the MPU 10 returns its control to step S101 to examine the data for the next sucessive waveform.

If the difference $\theta_{max}-\theta_{min}$ is smaller than the prescribed value $\Delta\theta_s$ in step S104, then the MPU 10 successively moves the phase in a direction in which the excitation signal PCLK is delayed with respect to the probe pulse signal ($\theta_{N-1}\rightarrow\theta_0$) to extract a phase $\theta'_{min}$ with which the jet current $I_j$ exhibits a minimum value $I_j'$ (min) (step S105).

Then, the MPU 10 discriminates whether or not $\theta'_{min}$ is equal to $\theta_{min}$ (step S106). If $\theta'_{min}$ is not equal to $\theta_{min}$, then the MPU 10 increments the excitation frequency $f_K$ by one step (step S109) and returns the control to step S101.

If $\theta'_{min}$ is equal to $\theta_{min}$ in step S106, the MPU 10 stores the difference $\Delta I_j=I_j(\max)-I_j$ (min) as a contrast at the excitation frequency $f_K$ into the memory (step S107).

Thereafter, the MPU 10 discriminates whether or not the excitation frequency $f_K$ is equal to the highest excitation frequency $f_{M-1}$ (step S108). If the excitation frequency $f_K$ is not equal to the highest excitation frequency $f_{M-1}$, then the MPU 10 increments the excitation frequency $f_K$ by one step (step S109) and then returns the control to step S101.

If the excitation frequency $f_K$ is equal to the highest excitation frequency $f_{M-1}$ in step S108, then the MPU 10 searches the contrasts $\Delta I_j$ stored in the memory for the highest value $\Delta I_j$ (max) and determines the excitation frequency $f_K$ corresponding to the maximum value $\Delta_{Ij}$ (max) as an optimum excitation frequency $f_{opt}$ (step S110), thereby ending the process.

After the optimum excitation frequency $f_{opt}$ is determined in this manner, the MPU 10 delivers an instruction to the reference oscillator CG to oscillate with an optimum excitation frequency $N \cdot f_{opt}$ corresponding to the optimum excitation frequency $f_{opt}$.

It is to be noted that, if the MPU 10 thereafter switches the switch SW1 to the deflection power supply E1 side, switches the multiplexer (1) MP1 to select the output of the synchronizing circuit SC and switches the multiplexer (2) MP2 to select the appropriate excitation phase, then the continuous jet type ink jet recording apparatus enters a printing mode.

Figure 7:
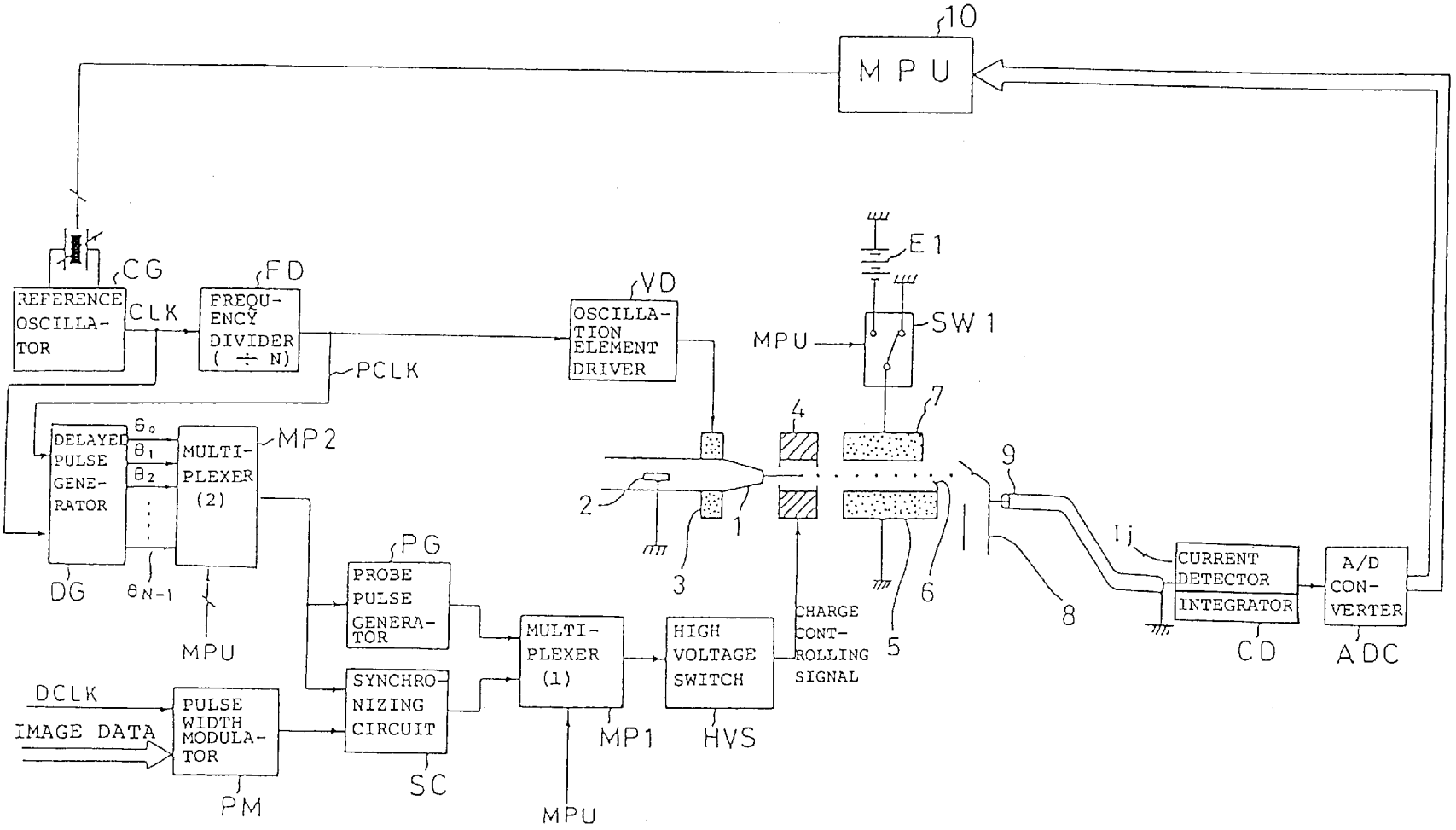
FIG. 7 is a block diagram showing a general construction of another continuous jet type ink jet recording apparatus to which the present invention is applied.

As shown in FIG. 7, there is shown in block diagram a general construction of another continuous jet type ink jet recording apparatus to which the present invention is applied. The continuous jet type ink jet recording apparatus of the present embodiment is a modification to and basically similar in construction to the continuous jet type ink jet recording type of the preceding embodiment of FIG. 1, and overlapping description of the common construction is omitted here to avoid redundancy.

The continuous jet type ink jet recording apparatus of the present embodiment is basically different from the continuous jet type ink jet recording type of the preceding embodiment in that, while the continuous jet type ink jet recording apparatus of the first embodiment delays, upon designation of the phase of the charge controlling signal with respect to the disintegration phase for an ink jet, the excitation signal PCLK to designate the phase, the continuous jet type ink jet recording apparatus delays the charge controlling signal to designate the phase. In particular, in the continuous jet type ink jet recording apparatus of the present embodiment, the excitation signal PCLK is inputted directly to the oscillation element driver VD while the output signal of the multiplexer (2) MP2 is inputted to the probe pulse generator PG and the synchronizing circuit SC. Accordingly, all of the components of the continuous jet type ink jet recording apparatus of the present embodiment are common and correspond to all of the components of the continuous jet type ink jet recording apparatus of the first embodiment.

Also in the continuous jet type ink jet recording apparatus of the present embodiment constructed in this manner, although it is different in that the jet current $I_j$ is measured successively displacing the phase of the probe pulse signal by $2\pi/n$, jet current waveform data are obtained for the excitation frequencies $f_0, f_1, f_2, f_3, \ldots, f_{M-1}$ similarly as in the continuous jet type ink jet recording apparatus of the first embodiment described hereinabove with reference to FIG. 1. In this instance, however, since the displacement in phase between the excitation signal PCLK and the charge controlling signal is reversed, the jet current waveforms are symmetrical (mirror images) to those of FIGS. 3 to 5 in regard to the leftward and rightward directions. Further, since the process of extracting characteristics of jet current waveforms to determine an optimum excitation frequency can be inferred readily from the description of the continuous jet type ink jet recording apparatus of the first embodiment, detailed description thereof is omitted here.

Figure 8:
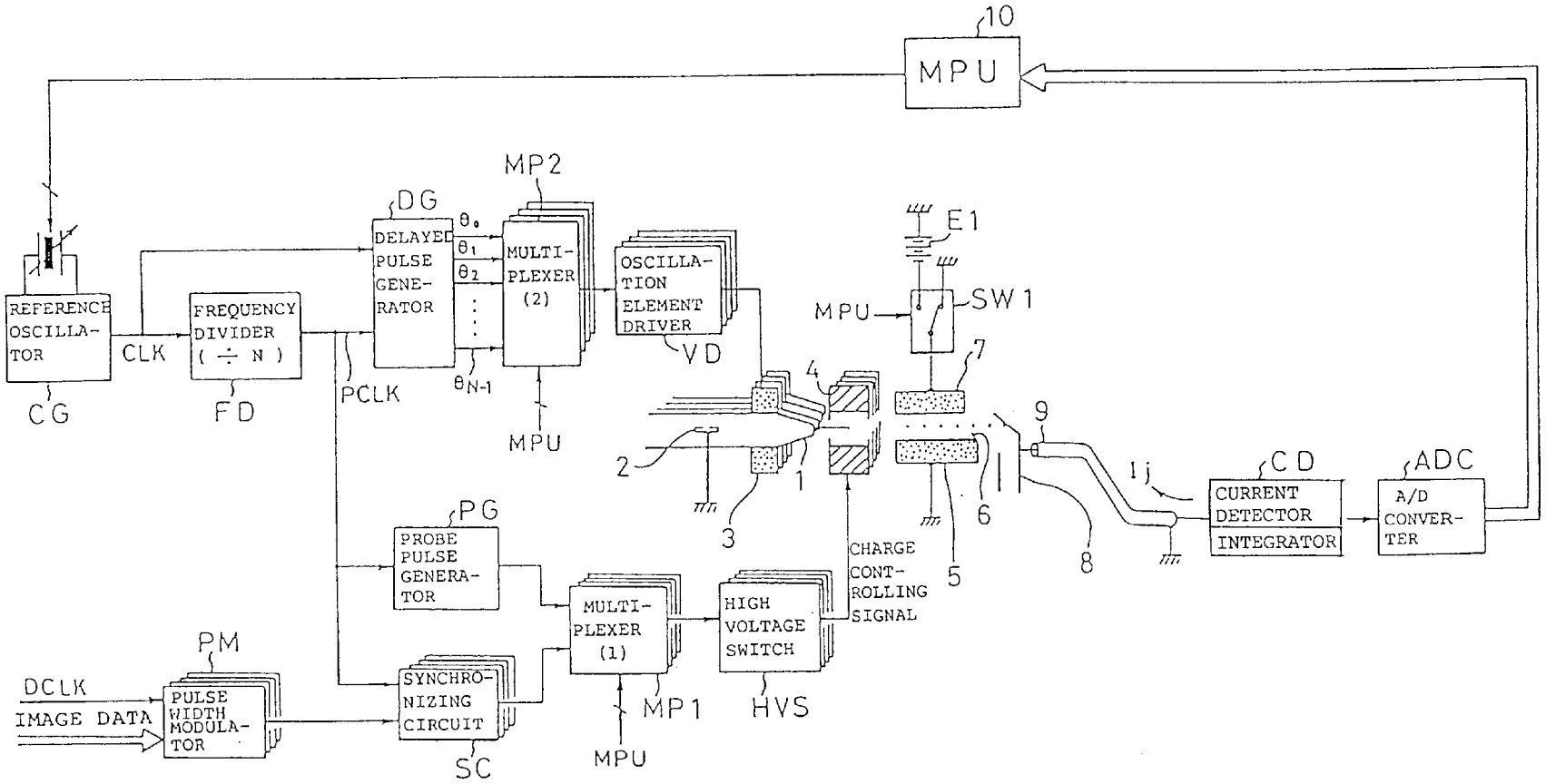
FIG. 8 is a similar view but showing a general construction of a further continuous jet type ink jet recording apparatus to which the present invention is applied.

Referring now to FIG. 8, there is shown in block diagram a general construction of a further continuous jet type ink jet recording apparatus to which the present invention is applied. The continuous jet type ink jet recording apparatus of the present embodiment is constructed as a modification to and basically similar in construction to the continuous jet type ink jet recording type of the preceding embodiment of FIG. 1, and overlapping description of the common construction is omitted here to avoid redundancy.

The continuous jet type ink jet printer of the present embodiment, however, is constructed as a continuous jet type ink jet recording apparatus which can print in color and, to this end, includes a plurality of nozzles 1. Thus, the continuous jet type ink jet recording apparatus of the present embodiment includes, independently for the four individual colors of C (cyan), M (magenta), Y (yellow) and BK (black), the components of the continuous jet type ink jet recording apparatus of the first embodiment shown in FIG. 1 except the reference oscillator CG, frequency divider FD, grounding electrode 5, knife edge 6, deflection electrode 7, deflection power supply E1, switch SW1, delayed pulse generator DG, probe pulse generator PG, conductive drop catcher 8, shield line 9, current detector CD, analog to digital converter ADC and MPU 10. It is to be noted that, if also the reference oscillator CG and the frequency divider FD are provided for each of the four colors individually independently of each other, the number of ink drops to be produced per unit time becomes different among the individual colors, and this is not preferable for a color-printable continuous jet type ink jet recording apparatus which controls the amounts of inks of the four colors to be applied to a recording medium to represent information in color.

In the continuous jet type ink jet recording apparatus having the construction described above, jet current waveform data (data quantity: 4M) are first measured with the excitation frequencies $f_0, f_1, f_2, f_3, \ldots, f_{M-1}$ for the the four nozzles 1 independently of each other, and then, if any one of the four nozzle 1 has exhibited a jet current waveform which suffers from the satellite drop problem, an excitation frequency or frequencies with which the nozzle 1 suffers from the satellite drop problem are excepted also with regard to the other three nozzles 1. Then, based on the remaining jet current waveforms, an excitation frequency with which the lowest value $\Delta I_j$ (min) exhibits the highest value among the four sets of contrasts $\Delta I_j$ corresponding to the four nozzles 1 is determined as an optimum excitation frequency (criterion for the optimum excitation frequency).

Figure 9:
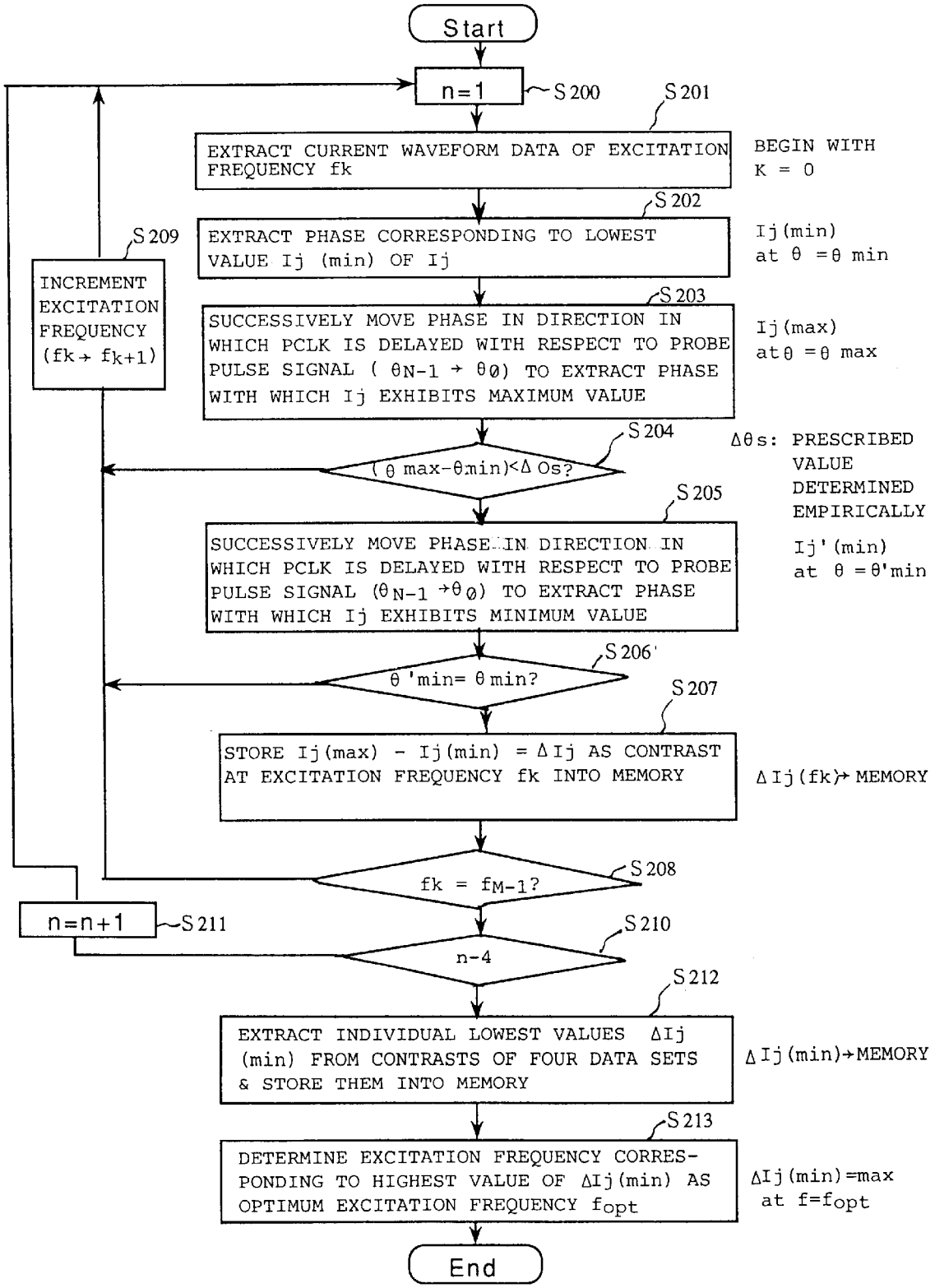
FIG. 9 is a flow chart illustrating an optimum excitation frequency determination process executed by an MPU shown in FIG. 8.
Figure 10:
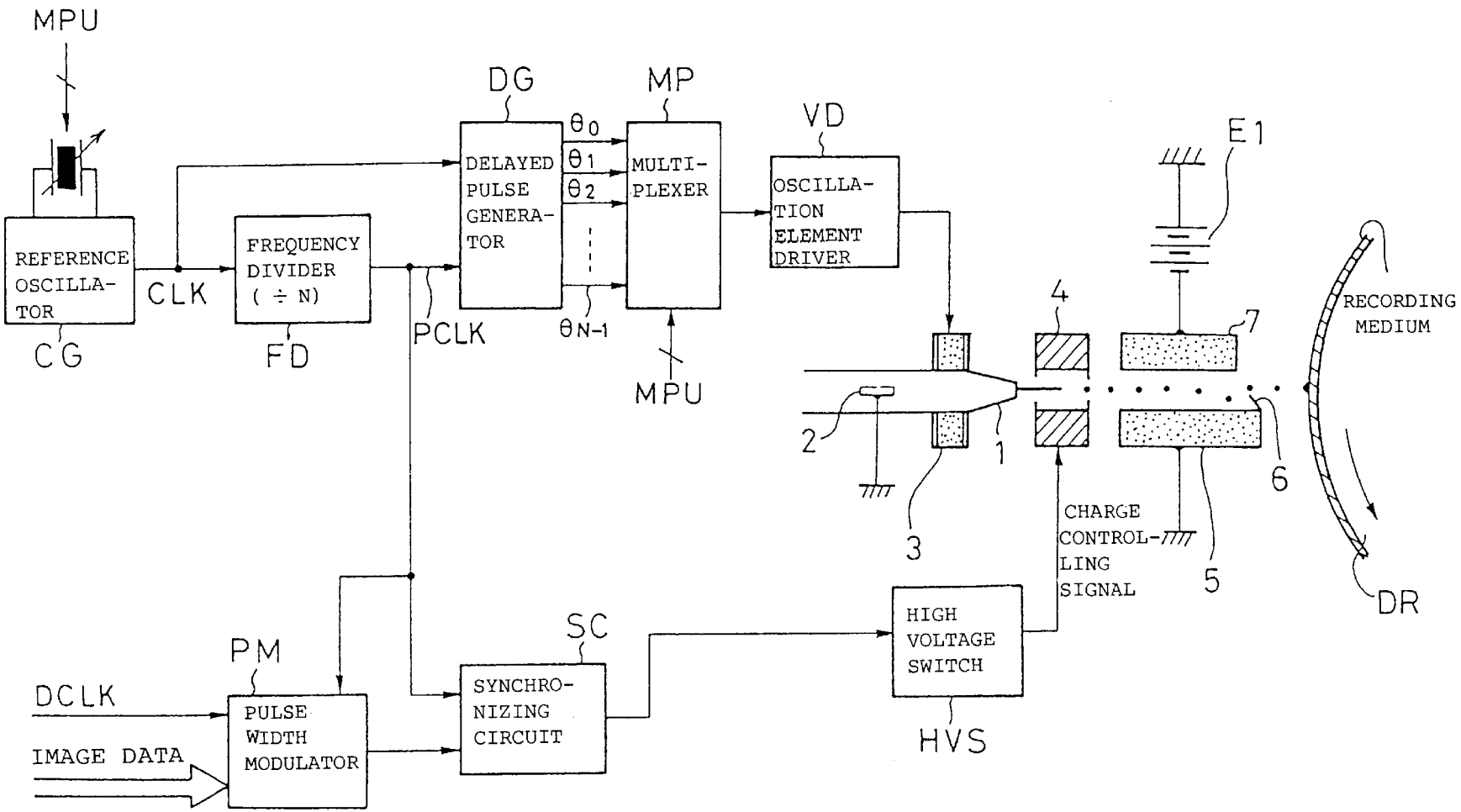
FIG. 10 is a block diagram showing a general construction of a conventional continuous jet type ink jet recording apparatus.

FIG. 9 illustrates in flow chart an optimum excitation frequency determination process executed by the MPU 10 based on the criterion for the optimum excitation frequency described above. As shown in FIG. 9, the optimum excitation frequency determination process includes a nozzle number 1 setting step S200, a current waveform data extraction step S201, a jet current lowest value corresponding phase extraction step S202, a jet current maximum value corresponding phase extraction step S203, a phase difference discrimination step S204, a jet current minimum value corresponding phase extraction step S205, a lowest value corresponding phase/minimum value corresponding phase comparison step S206, a contrast storage step S207, an excitation frequency highest value determination step S208, an excitation frequency increment step S209, a nozzle number 4 discrimination step S210, a nozzle number increment step S211, a contrast lowest value extraction step S212, and an optimum excitation frequency determination step S213.

Here, operation of the MPU 10 in the optimum excitation frequency determination process will be described with reference to FIG. 9.

First, the MPU 10 sets the nozzle number n to 1 (step S200), extracts current waveform data of the excitation frequency $f_K$ (beginning with K=0) (step S201) and extracts a phase $\theta_{min}$ corresponding to the lowest value $I_j$ (min) of the jet current $I_j$ (step S202).

Then, the MPU 10 successively moves the phase in a direction in which the excitation signal PCLK is delayed with respect to a probe pulse signal ($\theta_{N-1} \rightarrow \theta_0$) to extract a phase $\theta_{max}$ with which the jet current $I_j$ exhibits a maximum value (step S203).

Thereafter, the MPU 10 discriminates whether or not the difference $\theta_{max}-\theta_{min}$ is smaller than a prescribed value $\Delta\theta_s$ determined empirically (step S204). If the difference is not smaller, then the excitation frequency $f_K$ is incremented by one step (step S209), and then the MPU 10 returns its control to step S201.

If the difference $\theta_{max}-\theta_{min}$ is smaller than the prescribed value $\Delta\theta_s$ in step S204. then the MPU 10 successively moves the phase in a direction in which the excitation signal PCLK is delayed with respect to the probe pulse signal ($\theta_{N-1 \rightarrow \theta 0}$) to extract a phase $\theta'_{min}$ with which the jet current $I_j$ exhibits a minimum value $I_j'$ (min) (step S205).

Then, the MPU 10 discriminates whether or not $\theta'_{min}$ is equal to $\theta_{min}$ (step S206). If $\theta'_{min}$ is not equal to $\theta_{min}$, then the MPU 10 increments the excitation frequency $f_K$ by one step (step S209) and returns the control to step S201.

If $\theta'_{min}$ is equal to $\theta_{min}$ in step S206, then the MPU 10 stores the difference $\Delta I_j = I_J$ (max)$-I_j$ (min) as a contrast at the excitation frequency $f_K$ into the memory (step S207).

Thereafter, the MPU 10 discriminates whether or not the excitation frequency $f_K$ is equal to the highest excitation frequency $f_{M-1}$ (step S208). If the excitation frequency $f_K$ is not equal to the highest excitation frequency $f_{M-1}$, then the MPU 10 increments the excitation frequency $f_K$ by one step (step S209) and then returns the control to step S201.

If the excitation frequency $f_K$ is equal to the highest excitation frequency $f_{M-1}$ in step S208, then the MPU 10 discriminates whether or not the nozzle number n is equal to 4 (step S210). If the nozzle number n is not equal to 4, then the MPU 10 increments the nozzle number n by one (step S211) and returns the control to step S201. Consequently, the operations in steps S201 to S208 described above are repeated by a number of times equal to the number of the nozzles 1.

If it is discriminated in step S210 that the nozzle number n is equal to 4, then the MPU 10 searches the contrasts $\Delta I_j$ stored in the memory for the lowest values $\Delta I_j$ (min) for the individual nozzles 1 from among the contrasts $\Delta I_j$ whose excitation frequencies $f_K$ are common among the nozzles 1, and stores the lowest values $\Delta I_j$ (min) into the memory (step S212). Then, the MPU 10 determines the excitation frequency $f_K$ corresponding to the minimum value $\Delta I_j$ (min) of the highest contrast $\Delta I_j$ from among the stored minimum values $\Delta I_j$ (min) of the contrasts $\Delta I_j$ as an optimum excitation frequency $f_{opt}$ (step S213), thereby ending the process.

By the way, in the continuous jet type ink jet recording apparatus of the third embodiment shown in FIG. 8, since the conductive drop catcher 8, shield line 9, current detector CD and analog to digital converter ADC are provided commonly for the plurality of nozzles 1, jet current waveforms from the nozzles 1 are measured in a time series. However, if the conductive drop catcher 8, shield line 9, current detector CD and analog to digital converter ADC are provided for each of the nozzles 1, then jet current waveforms can be measured in parallel, and the measurement time is reduced remarkably.

It is to be noted that the construction wherein the charge controlling signal is delayed with respect to the excitation signal PCLK as in the continuous jet type ink jet recording apparatus of the second embodiment shown in FIG. 7 can naturally be applied similarly to the continuous jet type ink jet recording apparatus of the third embodiment which employs the plurality of nozzles 1.

Having now fully described the invention, it will be apparent to one of ordinary skill in the art that many changes and modifications can be made thereto without departing from the spirit and scope of the invention as set forth herein.

What is claimed is:

1. A continuous jet type ink jet recording apparatus, comprising:

jet formation means for discharging pressurized ink as a continuous jet from a nozzle and successively disintegrating the continuous jet into ink drops of a uniform size in synchronism with excitation of an oscillator mounted on said nozzle;

charging means for selectively charging the ink drops;

deflection means for applying a deflection electric field perpendicular to a flying axis of the jet to an ink drop charged by said charging means to deflect the ink drop in a direction perpendicular to the jet flying axis;

separation means for intercepting a charged ink drop deflected by said deflection means and allowing a straightforwardly advancing non-charged ink drop to pass thereby;

variable frequency oscillation means for outputting an excitation signal for exciting said oscillator;

switch means for switching the deflection electric field by said deflection means on and off;

probe pulse generation means for generating a probe pulse signal in synchronism with the excitation signal outputted from said variable oscillation means in a condition wherein the deflection electric field is controlled to an off state by said switch means;

phase shifting means for shifting a phase of one of the excitation signal and the probe pulse signal with respect to a phase of the other of the excitation signal and the probe pulse signal;

a conductive drop catcher for catching a charged ink drop charged by the probe pulse signal generated by said probe pulse generation means and having passed by said separation means;

current detection means for detecting the charge of charged ink drops caught by said conductive drop catcher as an electric current value;

analog to digital conversion means for converting the electric current value detected by said current detection means into digital data; and excitation frequency determination means for delivering an instruction to said variable frequency oscillation means to successively change an excitation frequency of the excitation signal to M stages, M being a positive integer, delivering another instruction to said phase shifting means to successively shift the phase of one of the excitation signal and the probe pulse signal with respect to the phase of the other of the excitation signal and the probe pulse signal by $2\pi/N$ with the excitation frequency at each of the M stages, N being a positive integer, re-arranging the digital data obtained by said analog to digital conversion means from the conversion of the successive phases at each of the M stages and storing the thus re-arranged data as M jet current waveform data sets, extracting, based on the M sets of jet current waveform data thus stored, characteristics of each of the jet current waveforms at the M individual stages as a function of the maximum and minimum jet current values thereof and the phase shift between the maximum and minimum jet current values to determine an optimum excitation frequency having a phase difference between the maximum and the minimum jet current values less than a pre-selected value and delivering a further instruction to said variable frequency oscillation means to output an excitation signal of the so-determined optimum excitation frequency.

2. A continuous jet type ink jet recording apparatus as claimed in claim 1, wherein said excitation frequency determination means extracts, from each of the M sets of jet current waveform data, a phase corresponding to a lowest value of the jet current, successively moves the phase in a direction in which the excitation signal is delayed with respect to the probe pulse signal to extract a phase with which the jet current exhibits a maximum value, further successively moves, if a difference between the phase with which the maximum value is exhibited and the phase corresponding to the minimum value is smaller than said pre-selected value, the phase in a direction in which the excitation signal is delayed with respect to the probe pulse signal to extract a phase with which the jet current exhibits a minimum value, and stores, if the phase with which the minimum value is exhibited is equal to the phase corresponding to the lowest value, a difference between the maximum value and the minimum value of the jet current as a contrast value at the excitation frequency, then searches the thus stored contrast values for a highest contrast value, and determines the excitation frequency corresponding to the highest contrast value as an optimum excitation frequency.

3. A continuous jet type ink jet recording apparatus as claimed claim 1, wherein said phase shifting means shifts the phase of the excitation signal while the phase of the probe pulse signal is fixed.

4. A continuous jet type ink jet recording apparatus as claimed in claim 1, wherein said phase shifting means shifts the phase of the probe pulse signal while the phase of the excitation signal is fixed.

5. A continuous jet type ink jet recording apparatus as claimed in claim 1, wherein said current detection means includes an integrator.

6. A continuous jet type ink jet recording apparatus, comprising:

n jet formation means each having a respective nozzle for discharging pressurized ink as a continuous jet therefrom and an oscillator mounted on the respective nozzle for successively disintegrating the continuous jet into ink drops of a uniform size in synchronism with excitation of the oscillator, n being an integer equal to or greater than 2;

n charging means each for selectively charging the ink drops;

deflection means for applying a deflection electric field perpendicular to flying axes of the jets to each ink drop charged by said charging means to deflect the ink drop in a direction perpendicular to the jet flying axis;

separation means for intercepting a charged ink drop deflected by said deflection means and allowing a straightforwardly advancing non-charged ink drop to pass thereby;

variable frequency oscillation means for outputting an excitation signal for commonly exciting the oscillator mounted on each respective nozzle;

switch means for switching the deflection electric field by said deflection means on and off;

probe pulse generation means for generating a probe pulse signal in synchronism with the excitation signal outputted from said variable frequency oscillation means in a condition wherein the deflection electric field is controlled to an off state by said switch means;

n phase shifting means each for shifting a phase of one of the excitation signal and the probe pulse signal with respect to a phase of the other of the excitation signal and the probe pulse signal;

a conductive drop catcher for catching a charged ink drop charged by the probe pulse signal generated by said probe pulse generation means and having passed by said separation means;

current detection means for detecting the charge of charged ink drops caught by said conductive drop catcher as an electric current value;

analog to digital conversion means for converting the electric current value detected by said current detection means into digital data; and excitation frequency determination means for delivering, successively for each of said n jet formation means, an instruction to said variable frequency oscillation means to successively change an excitation frequency of the excitation signal to M stages, M being a positive integer, and then another instruction to the phase shifting means to successively shift the phase of one of the excitation signal and the probe pulse signal with respect to the phase of the other of the excitation signal and the probe pulse signal by $2\pi/N$ with the excitation frequency at each of the M stages, N being a positive integer, rearranging the digital data obtained in regard to each of said jet formation means by said analog to digital conversion means from the conversion of the successive phases at each stage and storing the thus re-arranged data as nxM jet current waveform data sets, extracting, based on the nxM sets of jet current waveform data thus stored, characteristics of each of the jet current waveforms as a function of the maximum and minimum jet current values thereof and the phase shift between the maximum and minimum jet current values to determine an optimum excitation frequency having a phase difference between the maximum and the minimum jet current values less than a preselected value and delivering a further instruction to said variable frequency oscillation means to output an excitation signal of the so-determined optimum excitation frequency.

7. A continuous jet type ink jet recording apparatus as claimed in claim 6, wherein said excitation frequency determination means extracts, from each of the nxM sets of jet current waveform data, a phase corresponding to a lowest value of the jet current, successively moves the phase in a direction in which the excitation signal is delayed with respect to the probe pulse signal to extract a phase with which the jet current exhibits a maximum value, further successively move, if a difference between the phase with which the maximum value is exhibited and the phase corresponding to the minimum value is smaller than a pre-selected value, the phase in a direction in which the excitation signal is delayed with respect to the probe pulse signal to extract a phase with which the jet current exhibits a minimum value, and stores, if the phase with which the minimum value is exhibited is equal to the phase corresponding to the lowest value, a difference between the maximum value and the minimum value of the jet current as a contrast value at the excitation frequency, then searches the thus stored contrast values for the lowest values for the individual jet formation means from among the contrast values whose excitation frequencies are common among said jet formation means, searches the thus obtained minimum values of the jet current for the contrast value, and determines the excitation frequency corresponding to the contrast value as an optimum excitation frequency.

8. A continuous jet type ink jet recording apparatus as claimed in claim 6, wherein said phase shifting means shifts the phase of the excitation signal while the phase of the probe pulse signal is fixed.

9. A continuous jet type ink jet recording apparatus as claimed in claim 6, wherein said phase shifting means shifts the phase of the probe pulse signal while the phase of the excitation signal is fixed.

10. A continuous jet type ink jet recording apparatus as claimed in claim 6, wherein said current detection means includes an integrator.

11. A continuous jet type ink jet recording apparatus, comprising:

n jet formation means each for discharging pressurized ink as a continuous jet from a nozzle and successively disintegrating the continuous jet into ink drops of a uniform size in synchronism with excitation of an oscillator on said nozzle, n being an integer equal to or greater than 2;

n charging means each for selectively charging the ink drops;

deflection means for applying a deflection electric field perpendicular to the flying axes of the jets to each ink drop charged by said charging means to deflect the ink drop in a direction perpendicular to the jet flying axis;

separation means for intercepting a charged ink drop deflected by said deflection means and allowing a straightforwardly advancing non-charged ink drop to pass thereby;

variable frequency oscillation means outputting an excitation signal for commonly exciting the oscillator mounted on each respective nozzle;

switch means for switching the deflection electric field by said deflection means on and off;

probe pulse generation means for generating a probe pulse signal in synchronism with the excitation signal outputted from said variable frequency oscillation means in a condition wherein the deflection electric field is controlled to an off state by said switch means;

n phase shifting means each for shifting a phase of one of the corresponding excitation signal and the probe pulse signal with respect to a phase of the other of the corresponding excitation signal and the probe pulse signal;

n conductive drop catchers each for catching a charged ink drop charged by the probe pulse signal generated by said probe pulse generation means and having passed by said separation means;

n current detecting means each for detecting the charge of charged ink drops caught by the corresponding conductive drop catcher as an electric current value;

n analog to digital conversion means for converting the electric current values detected by said n current detection means into digital data; and excitation frequency determination means for delivering, simultaneously for said n jet formation means, an instruction to said variable frequency oscillation means to successively change an excitation frequency of the excitation signal to M stages, M being a positive integer, and then another instruction to each of said n phase shifting means to successively shift the phase of one of the excitation signal and the probe pulse signal with respect to the phase of the other of the excitation signal and the probe pulse signal by $2\pi/N$ with the excitation frequency at each of the M stages, N being a positive integer, re-arranging the digital data obtained in regard to each of said jet formation means by said analog to digital conversion means from the conversion of the successive phases at each stage and storing the thus re-arranged data as nxM jet current waveform data sets, extracting, based on the nxM sets of jet current waveform data thus stored, characteristics of the jet current waveforms as a function of the maximum and minimum jet current values thereof and the phase shift between the maximum and minimum jet current values to determine an optimum excitation frequency having a phase difference between the maximum and the minimum values less than a pre-selected value and delivering a further instruction to said variable frequency oscillation means to output an excitation signal of the so determined optimum excitation frequency.

12. A continuous jet type ink jet recording apparatus as claimed in claim 11, wherein said excitation frequency determination means extracts, from each of the nxM sets of jet current waveform data, a phase corresponding to a lowest value of the jet current, successively moves the phase in a direction in which the excitation signal is delayed with respect to the probe pulse signal to extract a phase with which the jet current exhibits a maximum value, further successively moves, if a difference between the phase with which the maximum value is exhibited and the phase corresponding to the minimum value is smaller than a pre-selected value, the phase in a direction in which the excitation signal is delayed with respect to the probe pulse signal to extract a phase with which the jet current exhibits a minimum value, and stores, if the phase with which the minimum value is exhibited is equal to the phase corresponding to the lowest value, a difference between the maximum value and the minimum value of the jet current as a contrast value at the excitation frequency, then searches the thus stored contrast values for the lowest values for the individual jet formation means from among the contrast values whose excitation frequencies are common among said jet formation means, searches the thus obtained minimum contrast values of the jet current for the highest contrast value, and determines the excitation frequency corresponding to the highest contrast value as an optimum excitation frequency.

13. A continuous jet type ink jet recording apparatus as claimed in claim 11, wherein said phase shifting means shifts the phase of the excitation signal while the phase of the probe pulse signal is fixed.

14. A continuous jet type ink jet recording apparatus as claimed in claim 11, wherein said phase shifting means shifts the phase of the probe pulse signal while the phase of the excitation signal is fixed.

15. A continuous jet type ink jet recording apparatus as claimed in claim 11, wherein said current detection means includes an integrator.

16. An optimum excitation frequency setting method, comprising the steps of:

discharging pressurized ink as a continuous jet from a nozzle and successively disintegrating the continuous jet into ink drops of a uniform size in synchronism with excitation of an oscillator mounted on said nozzle;

generating a probe pulse signal in synchronism with an excitation signal for said oscillator;

charging an ink drop with the probe pulse signal thus generated;

detecting the charge of thus charged ink drops as an electric current value;

converting the thus detected electric current value into digital data; and successively changing an excitation frequency of the excitation signal to M stages, M being a positive integer, successively shifting the phase of one of the excitation signal and the probe pulse signal with respect to the phase of the other of the excitation signal and the probe pulse signal by $2\pi/N$ with the excitation frequency at each of the M stages, N being a positive integer, re-arranging the digital data from the conversion of the successive phases at each stage and storing the thus re-arranged data as nxM jet current waveform data sets, extracting, based on the M sets of jet current waveform data thus stored, characteristics of the jet current waveforms at the individual stages to determine an optimum excitation frequency as a function of the maximum and minimum jet current values and the phase difference between the maximum and minimum jet current values, and outputting an excitation signal of the so-determined optimum excitation frequency.

17. An optimum excitation frequency setting method as claimed in claim 16, wherein the last mentioned step of successively changing an excitation frequency of the excitation signal includes the steps of extracting, from each of the M sets of jet current waveform data, a phase corresponding to a lowest value of the jet current, successively moving the phase in a direction in which the excitation signal is delayed with respect to the probe pulse signal to extract a phase with which the jet current exhibits a maximum value, further successively moving, if a difference between the phase with which the maximum value is exhibited and the phase corresponding to the minimum value is smaller than a pre-selected value, the phase in a direction in which the excitation signal is delayed with respect to the probe pulse signal to extract a phase with which the jet current exhibits a minimum value, and storing, if the phase with which the minimum value is exhibited is equal to the phase corresponding to the lowest value, a difference between the maximum value and the minimum value of the jet current as a contrast value at the excitation frequency, then searching the thus stored contrast values for a highest contrast value, and determining the excitation frequency corresponding to the highest contrast value as an optimum excitation frequency.

18. An optimum excitation frequency setting method, comprising the steps of:

discharging pressurized ink as a continuous jet from each of n nozzles and successively disintegrating the continuous jet into ink drops of a uniform size in synchronism with excitation of an oscillator mounted on each of said nozzles, n being an integer equal to or greater than 2;

generating a probe pulse signal in synchronism with an excitation signal for said oscillator;

charging an ink drop with the probe pulse signal thus generated;

detecting the charge of the charged ink drops as an electric current value;

converting the detected value into digital data; and successively changing, successively for each of said n nozzles, an excitation frequency of the excitation signal to M stages, M being a positive integer, and successively shifting the phase of one of the excitation signal and the probe pulse signal with respect to the phase of the other of the excitation signal and the probe pulse signal by $2\pi/N$ with the excitation frequency at each of the stages, N being a positive integer, re-arranging the digital data obtained in regard to each of said n nozzles from the conversion of the successive phases at each stage and storing the rearranged data as nxM jet current waveform data sets, extracting, based on the nxM sets of jet current waveform data thus stored, characteristics of the jet current waveforms at the M stages to determine an optimum excitation frequency as a function of the maximum and minimum jet current values and the phase difference between the maximum and minimum jet current values, and outputting an excitation signal of the optimum excitation frequency.

19. An optimum excitation frequency setting method as claimed in claim 18, wherein said successively changing step includes the steps of extracting, from each of the nxM sets of jet current waveform data, a phase corresponding to the lowest value of the jet current, successively moving the phase in a direction in which the excitation signal is delayed with respect to the probe pulse signal to extract a phase with which the jet current exhibits a maximum value, further successively moving the phase in a direction in which the excitation signal is delayed with respect to the probe pulse signal to extract a phase with which the jet current exhibits a minimum value, and storing, if the phase with which the minimum value is exhibited is equal to the phase corresponding to the lowest value, a difference between the maximum value and the minimum value of the jet current as a contrast value at the excitation frequency, then searching the stored contrast values for the lowest values for the individual jet formation means from among the contrast values whose excitation frequencies are common among said jet formation means, searching the obtained minimum values of the jet current for a highest contrast value, and determining the excitation frequency corresponding to the highest contrast value as an optimum excitation frequency.

* * * * *